US005494779A

United States Patent [19]

Rizzo et al.

[11] Patent Number: 5,494,779

[45] Date of Patent: Feb. 27, 1996

[54] PHOTOPRINTING ON METAL AND SIMILAR SUBSTRATES

[76] Inventors: Alberto Rizzo; Robin Narvaez, both of 188 Grand St., New York, N.Y. 10013

[21] Appl. No.: 341,022

[22] Filed: Nov. 17, 1994

[51] Int. Cl.[6] ..... G03C 1/93

[52] U.S. Cl. ..... 430/276.1; 430/327; 430/935; 430/938; 427/145

[58] Field of Search ..... 355/77; 430/30, 430/327, 396, 269, 935, 938, 276; 427/145

[56] References Cited

U.S. PATENT DOCUMENTS 4,384,040 5/1983 von Meer ..... 430/532

FOREIGN PATENT DOCUMENTS 58-093050 6/1983 Japan .

*Primary Examiner*—Charles L. Bowers, Jr.
*Assistant Examiner*—John A. McPherson
*Attorney, Agent, or Firm*—Charles E. Baxley

[57] ABSTRACT

The improvement in photoprinting on metallic surfaces which comprises masking the yellowish tint on the polyurethane coating on the metallic surface by including in the solution of the polyurethane coating being applied a Violet dye and a Dark Green dye.

4 Claims, No Drawings

PHOTOPRINTING ON METAL AND SIMILAR SUBSTRATES

BACKGROUND OF THE INVENTION

The present invention relates generally to surface imagery and, more particularly, to photoprinting on metal or other substrates and to improvements in such photoprinting.

Processes of photoprinting on metal or other substrates are well known. Such processes involve several steps beginning with preparing a surface of the substrate, coating the prepared surface with a photographic emulsion, exposing the photographic emulsion coating to a desired image, treating the exposed photographic emulsion coating, and finally covering the treated surface with a protective coating.

The preparation of the surface of the substrate involves first thoroughly washing the surface, usually with water and/or ammonia water, air drying, and then applying thereto a solution of a polyurethane usually by spraying. After drying, a polyurethane coating thus formed is suitable for application thereto of the photographic emulsion. However, in the usual practice, this polyurethane coating possesses a yellowish tint which interferes in subsequent photographic steps. It is, therefore, an object of this invention to provide means for eliminating or masking this yellowish tint.

EMBODIMENTS OF THE INVENTION

In accordance with the present invention it has been found that addition to the solution of the polyurethane of a violet dye or a dark green dye eliminates or mask the yellowish tint in the polyurethane coating. In carrying out the invention there is added to a 1:1 by weight solution of the polyurethane in a lacquer thinner, up to 4 drops, preferably 2 drops, of the desired dye and after thoroughly mixing the materials, spraying the resulting solution on the substrate A suitable polyurethane is "Minwax" a fast-drying polyurethane clear satin, obtainable from Minwax Company Inc., with addresses in Montvale, N.J. 07645 and Flora, Ill. 62839. The lacquer thinner solvent is USA T-70 Lacquer Thinner Reactor Solvent 483-9610, a non-photochemically reactive solvent comprised of methyl alcohol, tolvene, isopropyl acetate and propyl acetate and obtainable from United Specialties of America, with addresses in Orlando, Fla. 32808 and Sumter, S.C. 29150. Suitable dyestuffs are Deka Transparent #32—violet and Deka Transparent #34—dark green, obtainable from Deka Textile Farben GmbH. The present invention will become more clear from examples which follow. These examples are given by way of illustration and are not to be considered as limiting.

The procedures described in these examples can be reproduced on any size of a metal or other substrate, the formula breakdown described is suitable for a 15" by 24" steel plate.

EXAMPLE 1

A stainless steel plate was washed with water and 20% ammonia water using a sponge. A surface of the steel plate was air-dried. A solution of 3 oz. of Minwax (polyurethane) in 3 oz. of USA T-70 Lacquer Thinner 483-9610 was applied by spraying and then allowed to air dry for about 1 hour.

Another coating of the polyurethane was applied similarly by spraying, and a resulting coating again is allowed to dry for about 1 hour. The polyurethane coating thus prepared had a distinctive yellowish tint.

EXAMPLE 2

This example illustrates the process of this invention complete from preparation of a substrate through covering of the photograph with a protective coating.

Surface Preparation

| | |
|---|---|
| Step 1 | Wash a stainless steel surface with 32 oz. water and 20% ammonia solution with sponge. |
| Step 2 | Air dry the surface. |
| Step 3 | Mix 3 oz. of Minwax fast-drying polyurethane, clear satin with 3 oz. of USA T-70 Lacquer Thinner 483-9610 non-photochemically reactive. Mix in two (2) drops from a standard eyedropper of Deka Transparent #32 Violet, and two (2) drops of Deka Transparent #34 Dark Green. Mix together all these ingredients in a plastic bowl with a plastic stick. |
| Step 4 | Fill a container of an air brush spray gun, Badger Model 400, 8 oz. cup, with Step 3's mixture. |
| Step 5 | Spray the stainless steel surface with the spray gun, attached to a compressor set at thirty (30) pounds pressure. Spray once completely. Let air dry for one hour. |
| Step 6 | Spray the stainless steel surface again completely. Let the surface air dry for 2 hours or until completely dry and not tacky. It is also possible to hot air dry the surface. |
| Step 7 | Clean the air brush spray gun with lacquer thinner. Prepare the photographic emulsion. These next steps are performed in a dark room with a safe light on: |
| Step (1) | Take 2 oz. of Liquid Lite by Rockland Colloid Corp. |
| Step (2) | Mix the Liquid Lite with 2 oz. of 70% isopropyl rubbing alcohol. Add one part of working developer to ten parts Liquid Lite. |
| Step (3) | The developer is a photographic paper developer Kodak Dektol diluted one part Dektol to two parts water. |
| Step (4) | Put the Liquid Lite, the rubbing alcohol and the developer into the cannister of the air brush spray gun and mix them together. |
| Step (5) | Place a sheet of plastic on top of a table. Place the stainless steel surface face up on top of the plastic. |

Coating of Steel

| | |
|---|---|
| Step 1 | Spray the stainless steel surface in a horizontal orientation with the prepared photographic emulsion. |
| Step 2 | Dry the surface with a fan for approximately 5 to 10 minutes. |
| Step 3 | Spray the surface again in a vertical orientation. |
| Step 4 | Dry the surface with the fan. |
| Step 5 | Spray the surface again in a horizontal orientation. |
| Step 6 | Dry the surface with the fan. |
| Step 7 | Spray the surface again in a vertical orientation. |
| Step 8 | Dry the surface with the fan. |

Important Note:
The air brush spray gun's pressure should be set at 60 lbs.

Exposing

| | |
|---|---|
| Step 1 | Place the coated stainless steel surface under an enlarger. This step can be done either in a vertical or horizontal orientation. |
| Step 2 | Expose a negative (any size) for the required amount of time. |

Processing of the plate

| | |
|---|---|
| Step 1 | Place the coated stainless steel in a darkroom sink horizontally. |
| Step 2 | Make a solution of 1 part Dektol to 2 parts water exactly at 65° F. Place solution of Dektol in a water atomizer and spray the stainless steel surface for 2 minutes. |
| Fixing | |
| Step 1 | Mix Kodak powder fixer with water. Note: mix according to Kodak's instructions. |
| Step 2 | Place the fixer in another water atomizer. |
| Step 3 | Spray the fixer completely over the stainless steel surface and leave for 10 minutes. |
| Step 4 | Wash the surface with running water for 10 minutes. |
| Step 5 | Mix Kodak selenium toner at 1 to 20 ratio with water. |
| Step 6 | Immerse the surface for 6 minutes in the selenium solution. Note: Step 6 aids against UV rays. |
| Step 7 | Wash the surface for 20 minutes under running water. |
| Step 8 | Air dry the surface. |

Protection Coating

| | |
|---|---|
| Step 1 | Mix 4 oz. of Southern Coating Ryno-Thane base component 170-7759 clear. |
| Step 2 | Mix 1 oz. Ryno-Thane coating activator component 170-6922. |
| Step 3 | Mix with 2 oz. of Southern Coating Thinner Blend SC-1 #156-6620. |
| Step 4 | Mix steps 1 through 3 into the air brush spray gun attached to the compressor. |
| Step 5 | Spray onto the surface at 30 lb. pressure. |
| Step 6 | Air dry the surface. |
| Step 7 | Place the surface in a 200° F. oven for 10 minutes. |
| Step 8 | Spray the surface again. |
| Step 9 | Place the surface in a 200° F. oven for 10 minutes. |

EXAMPLE 3

The procedure of Example 2 was repeated except that in the preparation of the surface only 2 drops of "Deka Transparent" #32 Violet were used in place of both the "Deka Transparent" #32 Violet and "Deka Transparent" #34 Dark Green.

EXAMPLE 4

The procedure of Example 2 was repeated except that in the preparation of the surface only 2 drops of "Deka Transparent" #34 Dark Green were used in place of both the "Deka Transparent" #32 Violet and "Deka Transparent" #34 Dark Green.

The polyurethane coatings described in Examples 2 through 4 were completely free of any yellowish tint.

As alternate ingredients for use in the top (last applied) coating, Applicants suggest either of the following:

| Dupont Chroma Clear Multi Use 7500S Urethane Clear | |
|---|---|
| Contents: | acrylic resin, butyl acetate, 123-85-4; methyl ethyl ketone 78-93-3 ethyl acetate, 141-78-6; propylene glycol monomethyl ether acetate 108-65-6 xilene 1330-20-7, aromatic hydrocarbon 64742-95-6 when mixed contain: aliphatic polysocyanate resin and hexamethylene dissocyanate monomer 28182-81-2 |
| Dupont Chroma Clear Multi Use 7585S Overall Activator Reducer | |
| Contents: | propylene glycol monomethyl ether acetate 108-65-6; xylene 1330-20-7; hexyl acetate 108-84-9; aliphatic polysocyanate resin; hexamethylene discyanate monomer 8182-87-2. |

The foregoing specific embodiments of the present invention, as set forth in the specification, are for illustrative purposes only. Various changes and modifications may be made within the spirit and scope of this invention.

I claim:

1. A method for photoprinting on a clean dry metal surface, the method comprising steps as follows:

preparing a liquid polyurethane material in a lacquer thinner and adding thereto 2 to 8 drops of a colorant selected from a group consisting of a violet dye and a dark green dye and a mixture of equal portions of said dyes, thereof to about 6 oz. of a 50%. weight/weight solution of the polyurethane material in the thinner to mask yellowish tint;

thereafter coating the metal surface with the liquid polyurethane material;

thereafter coating the polyurethane material dry with a liquid photosensitive emulsion;

thereafter exposing the photosensitive emulsion dry to a desired light image to impart a photographic image on the emulsion;

thereafter applying a protective layer over the photographic image.

2. The method claimed in claim 1, with the colorant being the mixture of equal portions of the violet dye and the dark green dye.

3. The method claimed in claim 1, with the colorant being the violet dye.

4. The method claimed in claim 1, with the colorant being the dark green dye.

* * * * *